US007975855B2

(12) United States Patent
Lin et al.

(10) Patent No.: US 7,975,855 B2
(45) Date of Patent: Jul. 12, 2011

(54) UPRIGHT SHAFT POST CAPABLE OF ACCOMMODATING VARIOUS CONTAINERS

(75) Inventors: Pei-Ying Lin, Taichung Hsien (TW); Chanwa Nguy, Cornelius, NC (US)

(73) Assignee: Steelworks Hardware, LLC, Taichung (TW)

( * ) Notice: Subject to any disclaimer, the term of this patent is extended or adjusted under 35 U.S.C. 154(b) by 546 days.

(21) Appl. No.: 10/555,161

(22) PCT Filed: Oct. 26, 2005

(86) PCT No.: PCT/US2005/039397

§ 371 (c)(1),
(2), (4) Date: May 8, 2008

(87) PCT Pub. No.: WO2007/067161

PCT Pub. Date: Jun. 14, 2007

(65) Prior Publication Data

US 2009/0020489 A1 Jan. 22, 2009

(51) Int. Cl.
*A47F 7/00* (2006.01)

(52) U.S. Cl. ..... 211/70.6

(58) Field of Classification Search ..... 211/70.6, 211/106, 133.4, 205, 107, 169, 169.1, 165, 211/97, 69, 78, 163, 85.23; 206/216, 223, 206/349

See application file for complete search history.

(56) References Cited

U.S. PATENT DOCUMENTS

| | | | | | |
|---|---|---|---|---|---|
| 284,090 | A | * | 8/1883 | Tingle | 211/75 |
| 496,173 | A | * | 4/1893 | Smith | 211/75 |
| 1,814,740 | A | | 7/1931 | Rapp | |
| 2,633,997 | A | * | 4/1953 | Johnson | 211/96 |
| 2,650,717 | A | * | 9/1953 | Larson | 211/196 |
| 2,692,689 | A | * | 10/1954 | Wynne, Sr. | 211/165 |
| 3,166,286 | A | | 1/1965 | Pfaff | |
| 3,197,034 | A | * | 7/1965 | Deadrick | 211/205 |
| 3,425,658 | A | | 2/1969 | Cogdill | |
| 3,498,471 | A | * | 3/1970 | Dirkx | 211/131.1 |
| 3,517,824 | A | * | 6/1970 | Paque | 211/50 |
| 3,635,352 | A | | 1/1972 | Brooks | |
| 3,648,892 | A | * | 3/1972 | Morgan | 221/301 |
| 4,239,308 | A | * | 12/1980 | Bradley | 312/201 |
| 4,399,917 | A | | 8/1983 | Ohman | |
| 4,444,324 | A | | 4/1984 | Grenell | |
| 4,546,889 | A | | 10/1985 | Schoumaker | |
| 4,823,966 | A | | 4/1989 | Haber | |
| 4,901,846 | A | * | 2/1990 | Lehman | 206/1.8 |
| 4,999,943 | A | * | 3/1991 | Crabtree | 43/54.1 |
| 5,144,725 | A | * | 9/1992 | Krauss | 24/625 |

(Continued)

FOREIGN PATENT DOCUMENTS

EP 1520729 4/2005

(Continued)

OTHER PUBLICATIONS

Supplementary Search Report for EP Patent Application No. 0521111.1 dated Feb. 24, 2009.

*Primary Examiner* — Jennifer E. Novosad

(74) *Attorney, Agent, or Firm* — Levenfeld Pearlstein, LLC

(57) ABSTRACT

A tool storage device includes comprises a hollow upright pivot shaft end capped at the top and bottom ends. Fastening and coupling structures are attached to the end caps. These have apertures, which are used to fasten the tool storage device to an upright surface, such as a wall.

20 Claims, 9 Drawing Sheets

U.S. PATENT DOCUMENTS

| | | | | |
|---|---|---|---|---|
| 5,318,189 | A * | 6/1994 | Lee | 211/205 |
| 5,746,334 | A * | 5/1998 | Brandenberg | 211/205 |
| 5,799,787 | A | 9/1998 | Talbot | |
| 5,967,340 | A * | 10/1999 | Kao | 211/70.6 |
| 5,984,441 | A | 11/1999 | Stokhuijzen | |
| 6,092,656 | A * | 7/2000 | Ernst | 206/378 |
| 6,158,360 | A * | 12/2000 | Cheng | 108/103 |
| 6,425,490 | B1 * | 7/2002 | Ta | 211/116 |
| 6,431,373 | B1 * | 8/2002 | Blick | 211/70.6 |
| D471,358 | S * | 3/2003 | Yang | D3/276 |
| D471,359 | S * | 3/2003 | Yang | D3/276 |
| 6,568,546 | B1 * | 5/2003 | Huang | 211/205 |
| 6,648,390 | B1 * | 11/2003 | Yang | 294/161 |
| 6,854,607 | B2 * | 2/2005 | Tong | 211/70.6 |
| D505,548 | S * | 5/2005 | Yang | D3/282 |
| D541,612 | S * | 5/2007 | Lin et al. | D8/71 |
| 7,357,268 | B2 * | 4/2008 | Yang | 220/4.26 |
| 7,780,017 | B2 * | 8/2010 | Nguy et al. | 211/70.6 |
| 2003/0019775 | A1 * | 1/2003 | Ernst | 206/378 |
| 2003/0024837 | A1 * | 2/2003 | Chen | 206/378 |
| 2003/0070999 | A1 * | 4/2003 | Kao | 211/70.6 |
| 2003/0141211 | A1 * | 7/2003 | Tsai | 206/378 |
| 2004/0188366 | A1 * | 9/2004 | Tong | 211/70.6 |
| 2007/0102381 | A1 * | 5/2007 | Nguy et al. | 211/70.6 |
| 2008/0041799 | A1 * | 2/2008 | Nguy et al. | 211/70.6 |
| 2008/0061020 | A1 * | 3/2008 | Kaisler | 211/196 |
| 2008/0197131 | A1 * | 8/2008 | Lin et al. | 220/23.83 |
| 2009/0020489 | A1 * | 1/2009 | Lin et al. | 211/88.01 |
| 2009/0114783 | A1 * | 5/2009 | Lin et al. | 248/200 |

FOREIGN PATENT DOCUMENTS

| | | |
|---|---|---|
| EP | 1547730 | 6/2005 |

* cited by examiner 14
101
15
99
18
19
13
(103)
101
99
20
31
17
10
21
99
101
15
14
99
101
18
14

UPRIGHT SHAFT POST CAPABLE OF ACCOMMODATING VARIOUS CONTAINERS

FIELD OF THE INVENTION

The present invention relates to a tool storage device. A hollow upright pivot shaft end capped at the top and bottom are attached through coupling rings connected to various trays holding containers. Fastening structures are provided to facilitate the fastening of the tool storage device to an upright structure, such as a wall.

BACKGROUND AND RELATED ART

A variety of tool cases and racks have been disclosed. The present invention provides a versatile tool storage device comprising a hollow shaft to which various trays and containers are attached through coupling rings, which sleeve the upright shaft. The prior art has not contemplated the inventive tool storage device. As background, the following references are discussed.

The following references are of interest but are clearly unrelated to the claimed invention.

U.S. Pat. No. 5,984,441 to Stokhuijzen discloses a wall mount central member with a snap fit. There is a central shaft attached to the central mounting member. The central shaft is capable of various inserts.

U.S. Pat. No. 4,399,917 to Ohman discloses a certain rod assembly with a central mounting member with a snap fit.

U.S. Pat. No. 3,166,286 to Pfafz discloses a central mounting member where each end has matching members. One matching member attaches to the wall mount and the other has a porthole connection to attach to the object to be hanged on the wall.

U.S. Pat. No. 4,546,889 to Schoumaker, et al. discloses a central mounting member. There is a bracket with a protrusion to snap into a connection. A central shaft is attached to the mounting member and there is a clip end cap. The universal stretcher rail system for use in connection with a space dividing wall panel is not related to the tool storage device covered by the appended claims.

U.S. Pat. No. 3,425,658 to Cogdill discloses a quick release snap-fil wall mount rod assembly. This reference relates to a bar hanger for supporting electrical fixtures within a ceiling.

SUMMARY OF THE INVENTION

A novel flexible tool storage device is provided. The storage device can be attached on a wall or carried to a work site. The flexibility of the tool storage device provides flexibility by utilizing a hollow upright pivot shaft as a backbone for the attachment of a wide array of containers. The hollow upright pivot shaft may be of varying lengths. Preferably, it is about 1 to 3 feet long but it can be extended over several feet in length if the containers are to be adapted for carrying large tools such as axes, hammers, etc.

In other applications, relative small containers are attached to the hollow upright pivot shaft. Suitably, the containers are attached to the hollow upright pivot shaft by a plurality of coupling rings respectively pivotally coupled to the hollow upright pivot shaft. The number of coupling rings is inversely proportional to the size of the container. If there are large containers then there may be only two to five coupling rings. For smaller containers there are more coupling rings. The containers are suitably attached to trays, which cooperate with the coupling rings. Coupling rings are part of the trays and are located at one end of the tray proximal to an upright rib of the hollow upright pivot shaft. The trays are arranged with the coupling rings so the trays can suitably be turned about the hollow upright pivot shaft. This is an important feature enabling the user to readily access the contents of the containers located on the trays.

The tool storage device of this Invention comprises a hollow upright pivot shaft having two ends, a top end and a bottom end. The hollow upright pivot shaft is end capped on both ends. Each end cap has a coupling wall and a plughole framed in the coupling wall. Two connecting structure have a plug rod attached to each end cap through the plughole. Two fastening structures comprising a mounting base have a plurality of apertures for fastening to a wall. The fastening structures include a coupling unit detachably connected to the connecting structure.

DETAILED DESCRIPTION OF THE INVENTION

Figure 1:
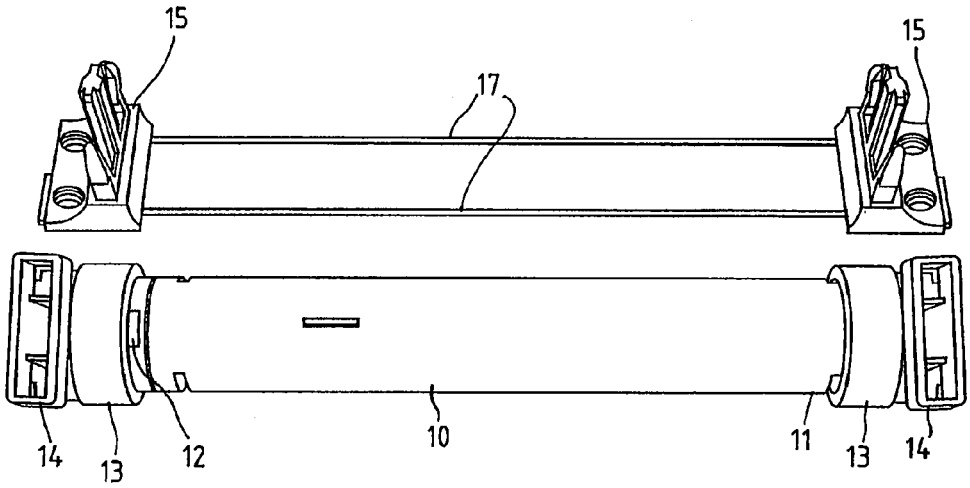
FIG. 1 illustrates the tool storage device of this invention where the fastening structures have not been attached to the connecting structure.

The present invention relates to a tool storage device comprising a hollow upright pivot shaft end capped at the top end and bottom end. Each end cap has a coupling wall and a plughole formed in the coupling wall. The tool storage device of this Invention has two connecting structures each having a plug rod attached to each end cap through the plughole. Two fastening structures comprise a mounting base having a plurality of apertures for fastening the tool storage device to an upright structure, such as a wall.

Each fastening structure comprises a coupling unit detachably connected to the connecting structure. The storage device can be about one foot in length for storing screws and light tools and five or more feet in length if heavy items such as axes and saws are stored.

The tool storage device of this Invention comprises a hollow upright pivot shaft having two ends, a top end and a bottom end. The hollow upright pivot shaft is end capped on the top end and bottom end, each end cap has a coupling wall and a plughole formed in the coupling wall, two connecting structures each having a plug rod attached to each end cap through the plughole, two fastening structures comprising a mounting base having a plurality of apertures for fastening to an upright support structure, and each fastening structure comprising a coupling unit detachably connectable to the connecting structure.

In general, the tool storage device and the containers are made of plastic, suitably polyolefins. The strength of the plastic used to produce the containers are adjusted to the weight of the load it has to bear.

The tool storage device of this invention comprises a hollow upright pivot shaft, a plurality of trays each having a plurality of coupling rings respectively pivotally coupled to the hollow upright pivot shaft. The trays are arranged so they can be turned about the hollow upright pivot shaft. Positioning structure are pivoted between the hollow upright pivot shaft and the coupling rings.

The trays have containers attached to them. The containers may be boxes for screws and the like or large containers in which are embedded tools such as crescent wrench, slip joint pliers, rib joint pliers, file, hacksaw, handsaw, screwdrivers, pivotal screwdriver, claw hammer, wood chisel, carpenter's hammer, bald-press hammer, mallet, twist drill, double twist auger bit, auger bit, hand drill, C-clamp, circular saw blade, and, etc.

Another feature of the invention is a tool storage device wherein a plurality of trays are respectively pivoted to said hollow upright pivot shaft.

The tool storage device has the upright hollow upright pivot shaft and trays designated to hold heavy carpenter tools. The trays are designed of high strength polyolefins having sufficient strength to hold carpentry tools such as screwdrivers, wrenches, axes and handsaws.

In another embodiment, the invention provides a handle attached to a side of the top end cap of the hollow upright pivot shaft. A further feature of the invention is to provide, in a specific embodiment, a tool storage device wherein the bottom end cap connects a base with an open chamber with a swivel mounted in said bottom open chamber.

This invention also provides a tool container positioning structure, said tool container positioning structure comprising a plurality of longitudinal grooves equidistantly spaced around the periphery of the hollow upright pivot shaft, and a plurality of spring strips respectively formed integral with the coupling rings of said tool containers, said spring strips each comprising a projection adapted for engaging said longitudinal grooves.

Further, each tool container comprises a tray and a tool container carried in said tray. The coupling rings of said tool container are respectively extended from the tray and are located proximal to the hollow upright pivot shaft.

Each storage container comprises a container and a tray adapted to accommodate the container, and the trays of said storage container each comprise a plurality of projecting strips aligned at one side, and said coupling rings are respectively formed integral with said projecting strips of said trays.

The tool storage device of this invention also comprises a plurality of coupling rings respectively rotatably mounted on the hollow upright pivot shaft at different elevations; and a plurality of support arms respectively coupled to the coupling rings, each said support arm having a proximal end, a distal end, a front wall, a top wall and a bottom wall respectively extending perpendicularly from a top and a bottom side of a front wall, and a plurality of receiving open chambers vertically cut respectively through said top and bottom walls for holding hand tools, each said receiving open chamber having a top opening in said top wall, and a bottom opening in said bottom wall.

The front opening of each said receiving open chamber has a top side opened and is disposably in communication with the top opening of the respective open receiving chamber, and a bottom side in the closed position. Each of the open receiving chambers has a neck portion in said top opening, and each of the support arms has a male coupling block at the proximal end thereof for coupling to one said coupling ring; each said coupling ring has a female coupling block at the periphery thereof for receiving the male coupling block of one said support arm. The male coupling block of each said support arm has a T-shaped coupling portion; the female coupling block of each said coupling ring defines an upwardly extended T-groove for receiving the T-shaped coupling portion of the male coupling block of one said support arm. The male coupling blocks of said support arms respectively extend from the proximal ends of said support arms at different angles. A plurality of spacers are respectively mounted on said hollow upright pivot shaft between each of two adjacent coupling rings, wherein each said spacer has a clamp at the periphery thereof for holding a hand tool.

Each said coupling ring has a plurality of locating grooves equidistantly spaced around the inner diameter thereof and axially extending two top and bottom sides thereof; said hollow upright pivot shaft comprises a plurality of spring strips longitudinally aligned in a line on the periphery thereof for holding said coupling rings in position, each said spring strip having a free end provided with a raised portion for engaging one locating groove of one said coupling ring.

The hollow upright pivot shaft further comprises a rib provided at the periphery thereof in line with and between two of said spring strips for engaging one locating groove of one said coupling ring to stop the coupling ring from rotation relative to said hollow upright pivot shaft. The receiving open chamber of each said support arm and the top and bottom openings of each said receiving open chamber are made gradually smaller in direction from said proximal end toward said distal end.

DETAILED DESCRIPTION OF THE EMBODIMENTS

FIG. 1 illustrates the tool storage device of this Invention where the fastening structures (15) have not been attached to the connecting structures (14). The figure shows the hollow upright hollow upright pivot shaft (10) having a top end (11) and a bottom end (12). Each end is end capped (13). Two optional connecting wires (17) are also shown in FIG. 1.

Figure 2:
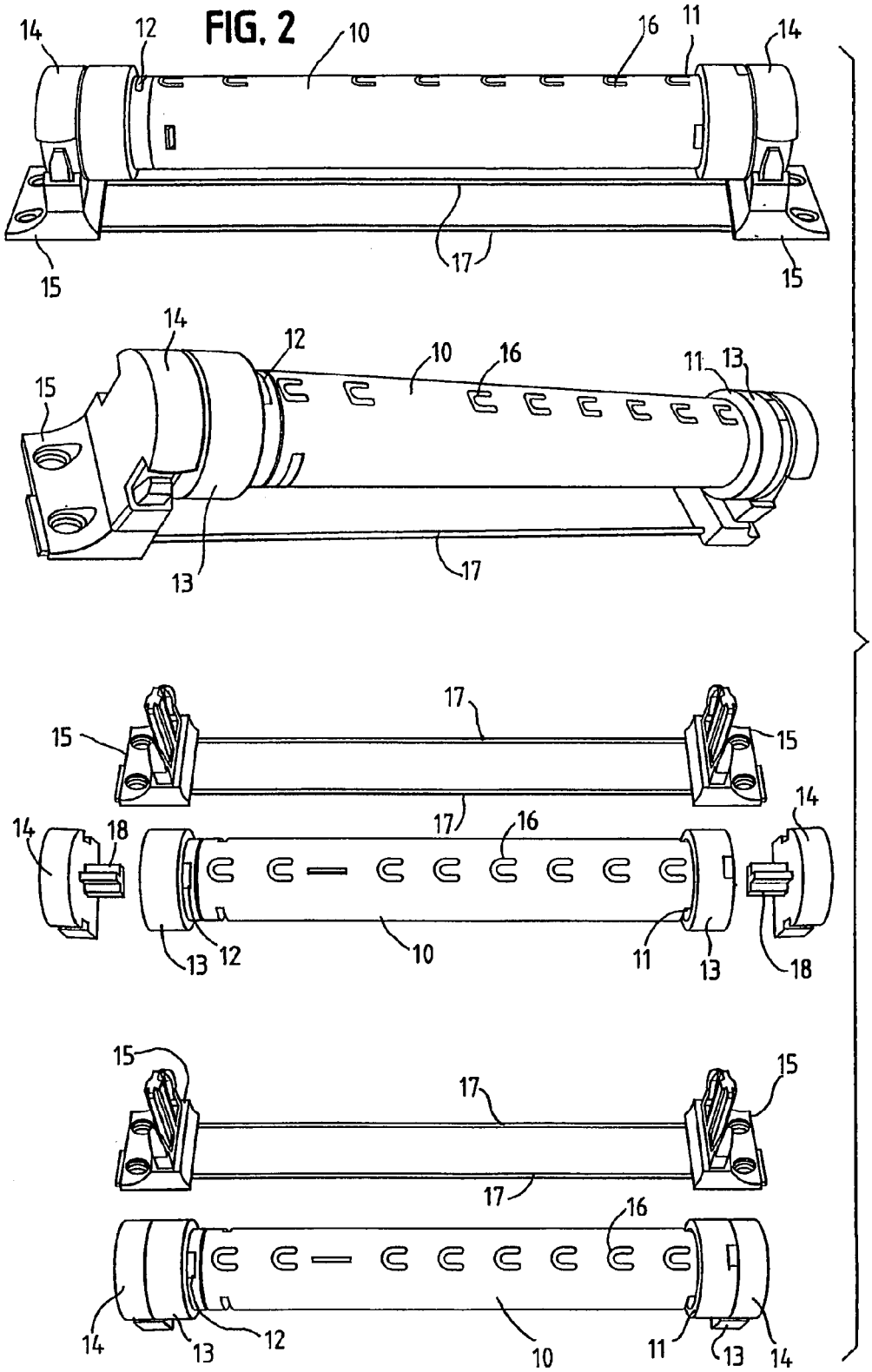
FIG. 2 illustrates the tool storage device illustrating in parts connecting structures, fastening structures, plurality of spring strips, and wire connections.

FIG. 2 illustrates the tool storage device of this invention where the hollow upright pivot shaft (10) has a plurality of spring strips (16). The figure shows two plug rods (18) being part of the connecting structure (14).

Figure 3:
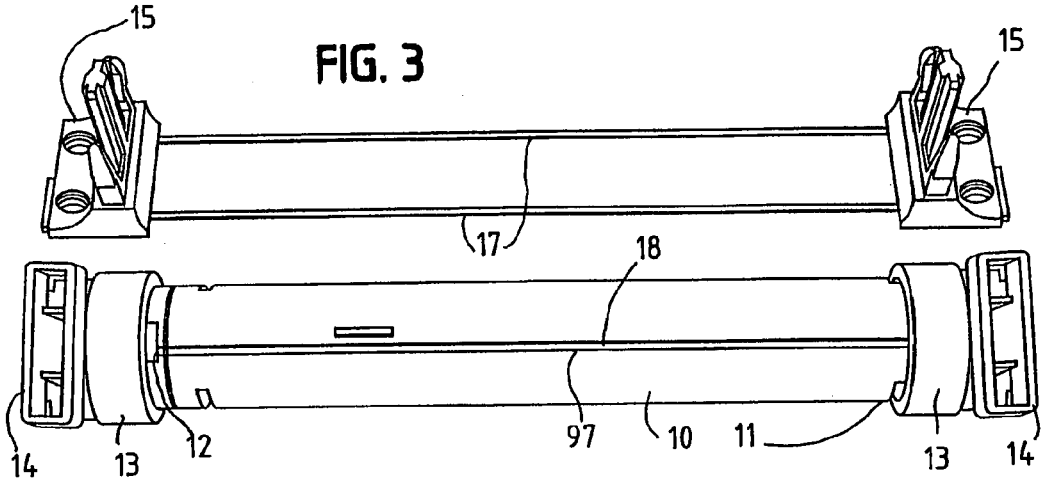
FIG. 3 illustrates the tool storage device of this invention showing three equivalent grooves going from the top to the bottom of the upright shaft.

FIG. 3 illustrates the hollow upright hollow upright pivot shaft having grooves (97). There are a total of three grooves (97) placed equidistantly from each other to facilitate coupling rings (21) to attach to the hollow upright pivot shaft (10).

Figure 4:
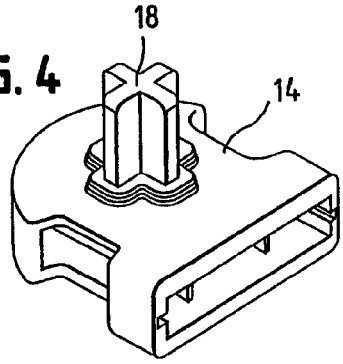
FIG. 4 illustrates the detachable connecting structures and the detachable fastening structures as separate components.
Figure 4:
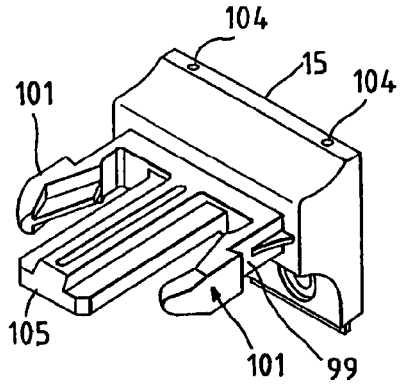

FIG. 4 illustrates the connecting structures (14) and the fastening structures (15). The connecting structure has a plug rod (18) and the fastening structures (15) have two apertures (104) through which optionally wires can be drawn. Two spring locking bars (99) are equally spaced from the center guide shaft (102). Each spring locking bar has a front guide face (101).

Figure 5:
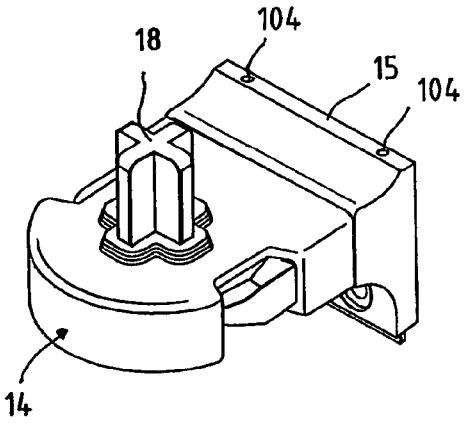
FIG. 5 illustrates the connecting structure and fastening structure combined as one unit.

FIG. 5, illustrates the assembled connecting structure (14) and fastening structure (15) showing a plug rod (18), which will be inserted into each end cap (13).

Figure 6:
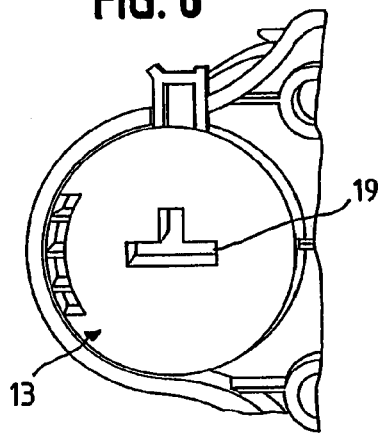
FIG. 6 illustrates either the top or bottom of the end cap of the hollow upright pivot shaft showing the plughole through which a plug rod of the connecting structure is attached to the end cap.

FIG. 6 illustrates the top of the end cap showing the plughole (19) through which plug rod (18) connects the connecting structure (14) and fastening structure (15) to the end caps (13) of the hollow upright hollow upright pivot shaft (10).

Figure 7:
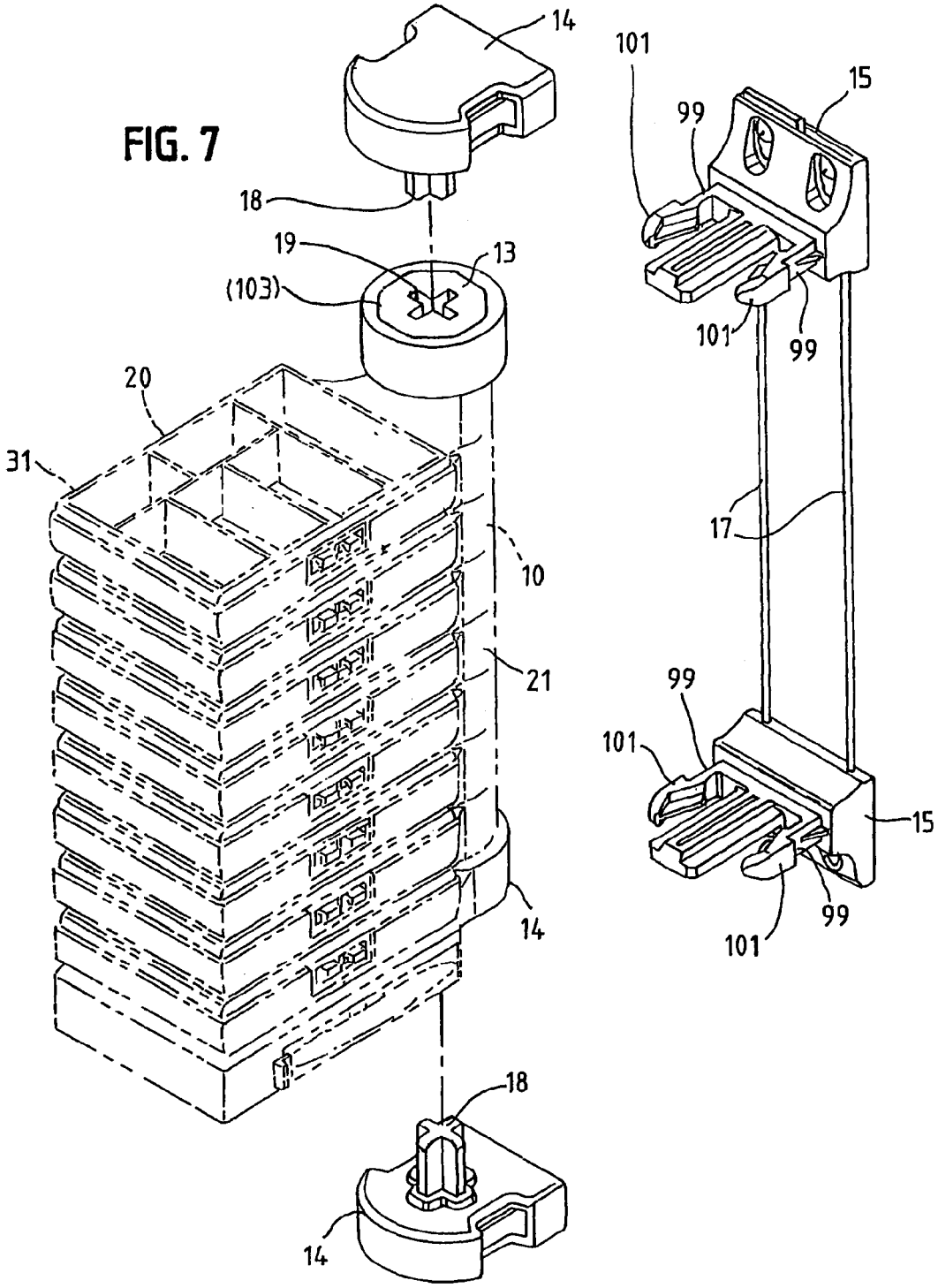
FIG. 7 illustrates one embodiment of the tool storage device of this invention showing the hollow upright pivot shaft, container and trays sleeving the hollow upright pivot shaft through coupling rings with the handles forming an integral part of the trays, also illustrating the operation of the end cap, connecting structures, and fastening structures.

FIG. 7 illustrates one embodiment of the inventive tool storage device including the tool rack set (20) and two end caps (14) capping the hollow upright pivot shaft. A plurality of coupling rings (21) attached to each tray (31) of the tool rack set. Each end cap (13) has a coupling wall (103) and a plughole (19) formed in the coupling wall (103) for receiving the plug rod (18) of the connecting structure (14).

Figure 8:
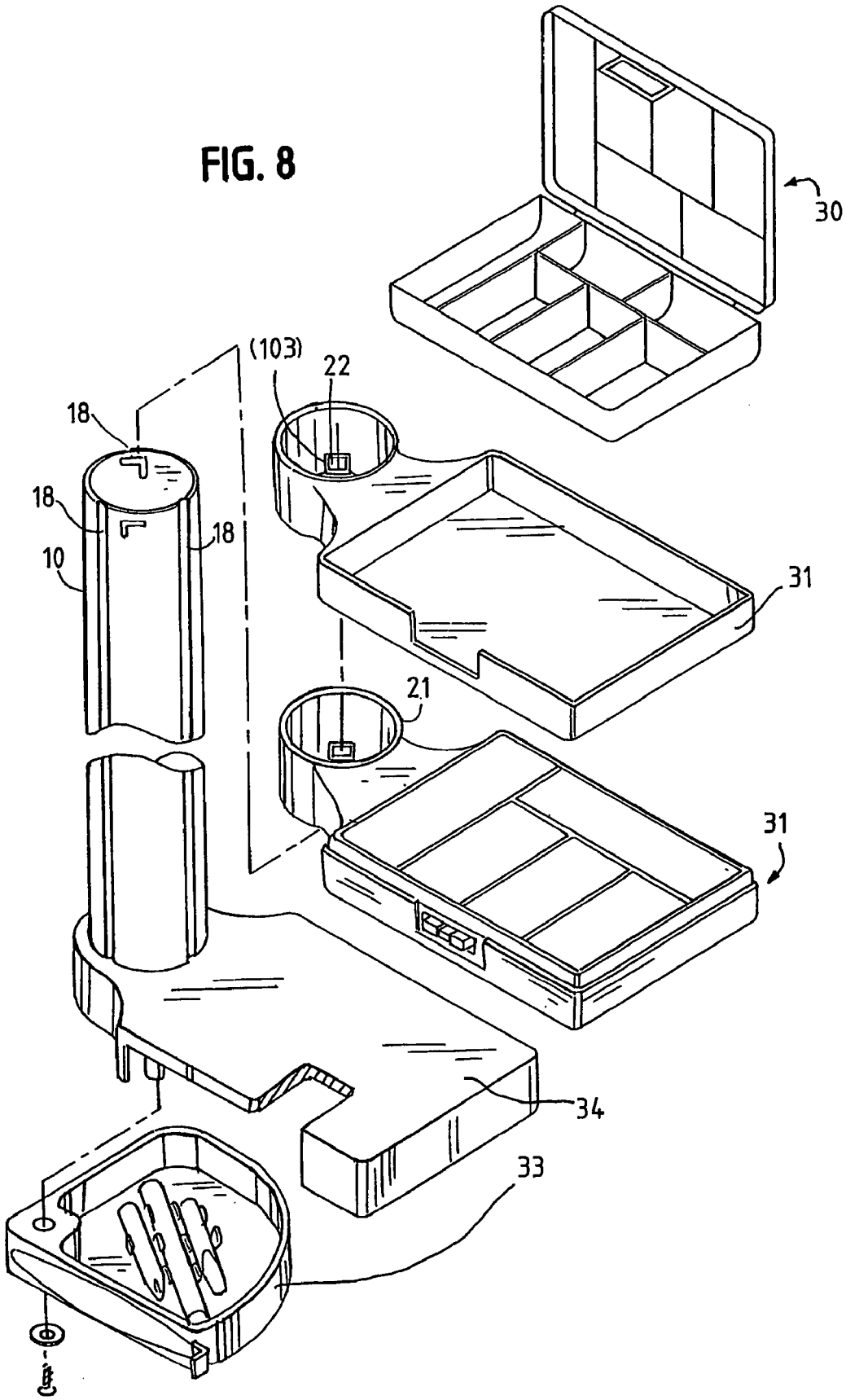
FIG. 8 is an exploded view of the tool storage device of the present invention. It illustrates parallel connecting structures attached to trays and also illustrates a swivel case mounted in the bottom in the base attached to the end cap.

FIG. 8 illustrates the hollow upright pivot shaft (10), grooves (18), carrier frame or tray (31), coupling rings (21), the box body (30), and a plurality of retaining spring strips (32). The spring strips (32) are formed integral with the coupling rings (21) of the carrier frames (31) of the tool boxes (30) by utilizing two axially extended cuts (103) in each coupling ring (21) of the carrier frame (31) of the tool boxes (30). The retaining spring strips each have a projection (22) adapted for engaging one longitudinal groove (18) of the hollow upright pivot shaft (10). After installation of the tool boxes (30), the projections (22) of the retaining springs are respectively engaged into the longitudinal groove (18) of the hollow upright pivot shaft (10) preventing the tool boxes (30) from rotary motion relative to the hollow upright pivot shaft (10). However, when the user turns one tool box (30) about the hollow upright pivot shaft (10), the projection (22) is moved with the respective coupling ring (21) away from the corresponding longitudinal groove (18) of the hollow upright pivot shaft (10) enabling the respective tool box (30) to be turned about the hollow upright pivot shaft (10) to the desired direction. FIG. 8 also illustrates the situation when the base attached to the end cap (13) connects to an open chamber (34) wherein a swivel (33) is mounted in said bottom open chamber (34).

Figure 9:
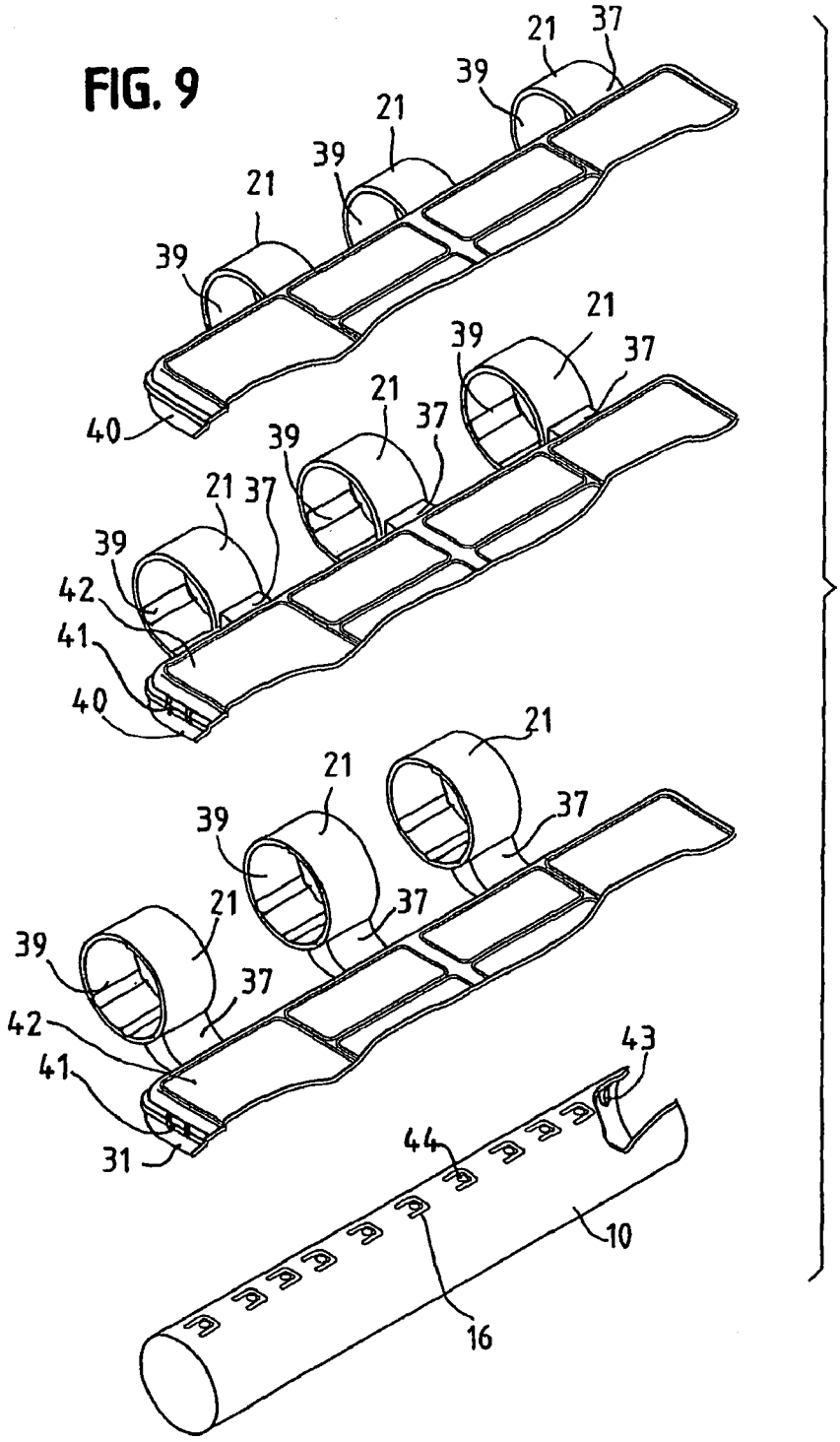
FIG. 9 is an exploded view in an enlarged scale of a part of the storage device of this invention.

FIG. 9 illustrates the relationship between the hollow upright pivot shaft (10), coupling rings (21), and the plurality of spring strips (16). The projection strips (37) of the trays (40) of the flat rectangular storage cases (41) are so arranged that the coupling rings (21) of the trays (31) of the flat rectangular storage cases (42) are aligned for the insertion of the hollow upright pivot shaft (10). The tray (31) positioning structure comprises a plurality of spring leaves (44) respectively formed integral with the hollow upright pivot shaft (10) and aligned in a line. Each spring leaf (44) has a raised engagement portion (not shown) and a plurality of locating grooves (39) respectively formed inside the coupling rings (21). When turning one tray (31) about the hollow upright pivot shaft (10), the locating grooves (39) of the coupling rings (21) are forced into an engagement with the raised engagement portions of the corresponding spring leaves (44) of the hollow upright pivot shaft (10) and therefore the tray (31) is locked into position. When applying a biasing force to the tray (31), the locating grooves (39) of the coupling rings (21) of the tray (31) are disengaged from the raised engagement portion of the corresponding spring leaves (44) at the hollow upright pivot shaft (10).

Figure 10:
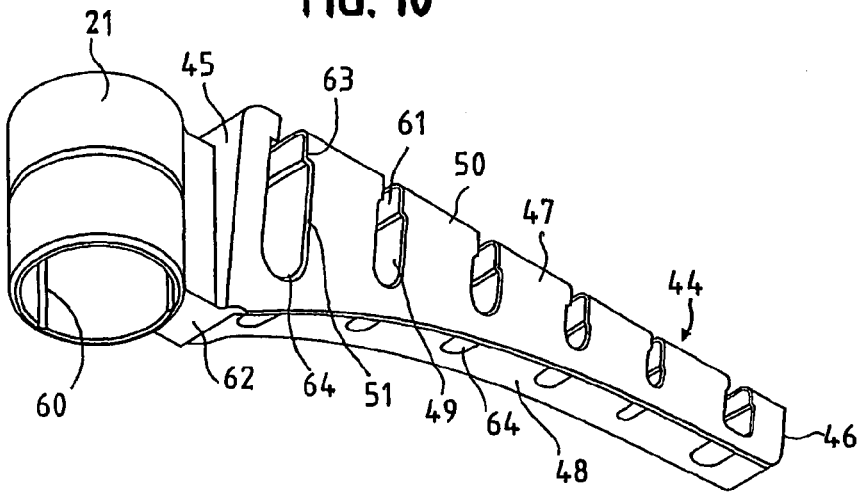
FIG. 10 is an exploded view of a part of a tool holder set showing the relationship between coupling rings and the upright shaft.
Figure 15:
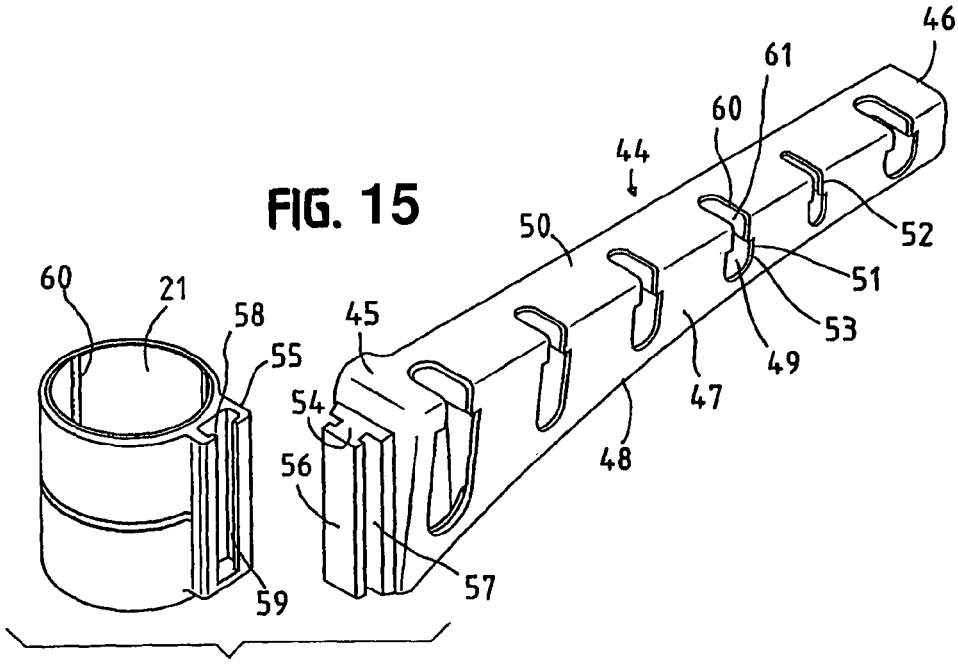
FIG. 15 illustrates an arm of the tool storage device.

FIG. 10 shows the relationship between the coupling rings (21) and a support arm (44). A support arm (44) is formed of a frame bar having a proximal end (45) and a distal end (46), a front wall (47) extending between the proximal end (45) and a distal end (46), and a top wall (50) and a bottom wall (48) respectively extending from the top and bottom sides of the front wall (47) at right angles between the proximal end (45) and the distal end (46). The support arm (44) has a thickness gradually reducing the proximal end (45) toward the distal end (46).

The support arm (44) has a plurality of receiving open chambers (49) respectively vertically cut through the top and bottom walls (50), (48). Each receiving open chamber (49) has a front opening (51) which extends through the front wall (47) and has a top side (63) opened and a bottom side (64) closed, a top opening (60) which extends through the top wall (50) and disposed in communication with the opened top side (52) of the respective front opening (51), a neck portion (61) formed in the top opening (60), a bottom opening (64) of each receiving open chamber (49) are made gradually smaller in size in direction from the proximal end (45) toward the distal end (46).

The support arm (44) further comprises a coupling block (54) at the proximal end (45) connectable to a female coupling block (62) at the periphery of a coupling ring (21). The male coupling block (54) is a T-block comprising a flat outer coupling portion (56) and a narrow inner connecting portion (57) connected between the flat outer coupling portion (56) and the proximal end (45) of the support arm (44). The female coupling, block (62) of the coupling ring (21) has a single-open-end coupling groove (58) for receiving the flat outer coupling portion (54) of the male coupling block (62), and a narrow passage aperture (59) for passing of the narrow inner connection portion (57) of the male coupling block (55) upon insertion of the flat outer coupling portion (56) into the single-open-end coupling groove 58).

Figure 11:
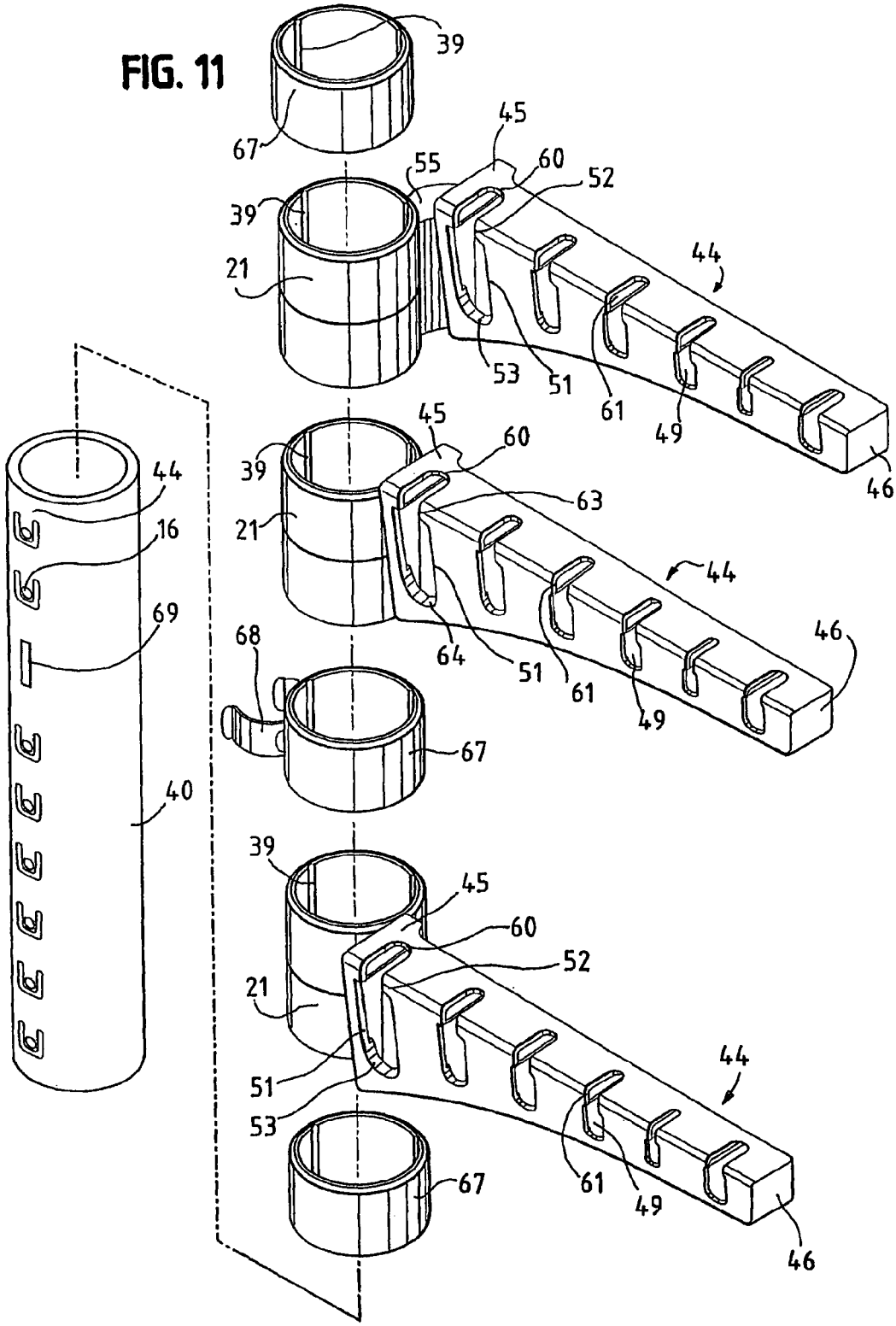
FIG. 11 is a view of coupling rings and handles.

FIG. 11 discloses a plurality of coupling rings (21) and spacers (67). These are alternately mounted in the hollow upright pivot shaft (10) at different elevations. The tool storage device is as shown in FIG. 1. FIG. 11 illustrates different ways to attach coupling rings and tool containers to the hollow upright pivot shaft (10). The coupling rings (21) and spacers (67) each have a plurality of locating grooves (39) equidistantly spaced around the inside wall and extending in axial direction. Each spacer (67) has a clamp (68) at the periphery. The hollow upright pivot shaft (10) has a plurality of spring strips (44) formed integral with the periphery and longitudinally aligned. Each spring strip (44) has one end, namely, the proximal end connected to the periphery of the hollow upright pivot shaft (10) and the other end, namely, the distal end provided with a raised portion (16) for engaging one locating groove (39) of one coupling ring (21) or one spacer (67). The user can turn one support arm (44) with the hand to rotate the respective coupling ring (21) on the hollow upright pivot shaft (10), to change the support arm (44) from one angle to another relative to the hollow upright pivot shaft (10), subject to the pitch between each two locating grooves (39). Upon release, the hand from the support arm (44), the raised portion (16) of the respective spring strip (44) engages the respective locating groove (39) of the coupling ring (21) to hold the coupling ring (21) to the adjusted angular position. Further, the hollow upright pivot shaft (10) has a rib (69) provided at the periphery line with spring strips (44) for engaging one locating groove (39) of one coupling ring (21)

to prohibit the coupling ring (21) from rotary motion relative to the hollow upright pivot shaft (10).

Figure 12:
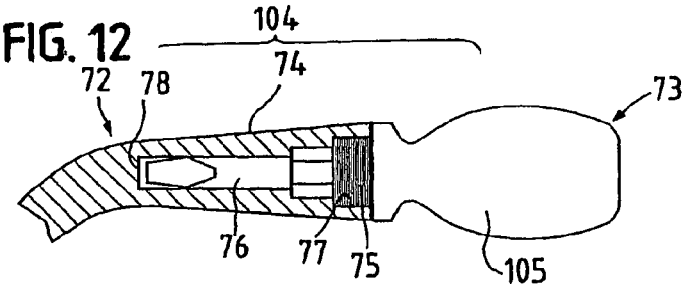
FIG. 12 illustrates a tool handle.

FIG. 12 illustrates a carrying handle (104) for the tool storage device of this invention. The handle (104) comprises a handle body (72) and a hand tool (73). The hollow shank (74) has an axial aperture (78) axially extended to the free end and an Inner thread (77) of the hollow shank (74) in the axial aperture (78). The hand tool (73) comprises a handle (105) and a threaded shoulder (75) disposed at one end of the handle (105) and adapted for detachably holding a tool bit (76) and threading into the inner thread (77) of the hollow shank (74). The axial aperture (78) is large enough for receiving the tool bit (76) and the threaded shoulder (75) of the hand tool (73).

Figure 13:
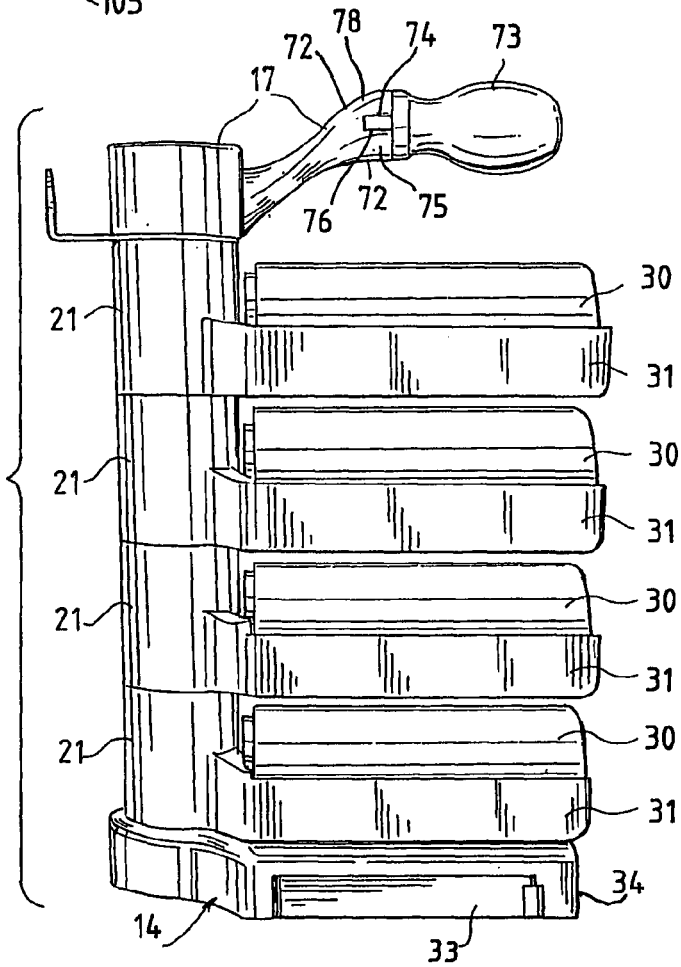
FIG. 13 illustrates a tool storage device.

FIG. 13 illustrates the tool storage device including the handle (104) described in FIG. 12 and provides a swivel (33) mounted in the bottom open chamber (34). The swivel (33) is used to store small items such as small screws and etc.

Figure 14:
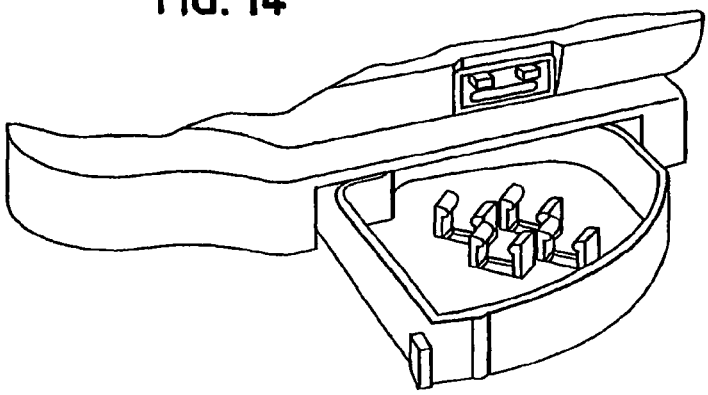
FIG. 14 illustrates a detailed view of the swivel mounted in the bottom open chamber.

FIG. 14 is a detailed view of the swivel (33) and the bottom of the tool storage device of this invention.

Various modifications to the invention are contemplated. It is understood, therefore, that within the scope of the appended claims, the invention may be practiced otherwise than specifically described.

What is claimed is:

1. A tool storage device comprising:

(a) a hollow upright shaft having two ends, a top end and a bottom end;

(b) the shaft end capped on the top end and the bottom end;

(c) each end cap having a coupling wall and a plughole formed in the coupling wall;

(d) a plurality of detachable connecting structures each having a plug rod attached to each end cap through the plughole; and (e) a plurality of fastening structures comprising a base having a plurality of apertures for fastening to an upright support structure;

wherein the connecting structures are each detachably connectable to respective fastening structures at the top and bottom ends of the capped hollow upright pivot shaft.

2. The tool storage device of claim 1, comprising a plurality of tool containers including trays having a coupling ring attached at one end respectively pivoted to said hollow upright shaft and arranged in a stack, said containers each comprising a coupling ring respectively sleeved onto said hollow upright shaft, the coupling rings configured for pivoting about the hollow upright shaft.

3. The tool storage device of claim 2, wherein each tool container comprises a carrier frame and a tool container carried in the carrier frame; said coupling rings of said tool containers are respectively extended from the carrier frames of said tool containers.

4. The tool storage device of claim 1, comprising a handle attached to a side of the top end cap of the hollow upright shaft.

5. The tool storage device of claim 1, wherein each base of the fastening structure has at least one aperture suitable for receiving a wire rod.

6. The tool storage device of claim 5, wherein said wire rod has a length equal to a height of the tool storage device.

7. The tool storage device of claim 1, further comprising a tool container positioning structure, said tool container positioning structure comprising a plurality of longitudinal grooves equidistantly spaced around the periphery of said hollow upright shaft, and a plurality of spring strips respectively formed integral with the coupling rings of said tool containers, said spring strips each comprising a projection adapted for engaging said longitudinal grooves.

8. The tool storage device of claim 1, comprising:

(a) a plurality of coupling rings respectively rotatably mounted on the hollow upright shaft at different elevations;

(b) a plurality of support arms respectively coupled to the coupling rings, each said support arm comprising a proximal end, a distal end, a front wall, a top wall and a bottom wall;

(c) said support arm extending respectively perpendicularly from top and bottom sides of said front wall; and (d) a plurality of receiving chambers respectively cut through said top and bottom walls for holding hand tools, each said receiving chamber having a top opening in said top wall, and a bottom opening in said bottom wall.

9. The tool storage device of claim 8, wherein the opening of each said receiving open chamber has a top side in communication with the receiving open chamber and a closed bottom side.

10. The tool storage device of claim 9, wherein each said receiving chamber has a neck portion in said top side opening.

11. The tool storage device of claim 8, wherein each said support arm has a male coupling block at the proximal end thereof for coupling to one said coupling ring; each said coupling ring has a female coupling block at the periphery thereof for receiving the male coupling block of one said support arm.

12. The tool storage device of claim 11, wherein the male coupling block of each said support arm has a T-shaped coupling portion; the female coupling block of each said coupling ring defines an upwardly extended T-groove for receiving the T-shaped coupling portion of the male coupling block of one said support arm.

13. The tool storage device of claim 12, wherein the male coupling block of said support arm respectively extends from the proximal end of said support arm at different angles.

14. The tool storage device of claim 13, further comprising a plurality of spacers respectively mounted on said hollow upright shaft between each of a plurality of adjacent coupling rings.

15. The tool storage device of claim 14, wherein each said spacer has a clamp at the periphery thereof for holding a hand tool.

16. The tool storage device of claim 8, wherein each coupling ring has a plurality of locating grooves equidistantly spaced around the inner diameter thereof and extending on two sides thereof.

17. The tool storage device of claim 16, wherein the hollow upright shaft includes a plurality of spring strips longitudinally aligned on the periphery of the side for holding the coupling rings in position, each said spring strip having a free end with a raised portion for engaging one locating groove of one said coupling ring.

18. The tool storage device of claim 8, wherein said hollow upright shaft further comprises a rib provided at the periphery thereof in line with and between a plurality of spring strips for engaging one locating groove of one coupling ring to stop the coupling ring from rotating relative to the hollow upright pivot shaft.

19. The tool storage device of claim 8, wherein the receiving chamber of each said support arm and the top and bottom openings of each said receiving chamber are graduated in direction from the proximal end toward the distal end, the size becoming progressively smaller toward said distal end.

20. The tool storage device of claim 1, wherein the bottom end cap connects with a receiving open chamber with a swivel connected in said open receiving chamber.

* * * * *